US007243376B2

(12) United States Patent
Johnson

(10) Patent No.: US 7,243,376 B2
(45) **Date of Patent: *Jul. 17, 2007**

(54) CUT AWAY VEST

(75) Inventor: Matthew A. Johnson, St. Louis, MO (US)

(73) Assignee: Eagle Industries Unlimited, Inc., Fenton, MO (US)

( * ) Notice: Subject to any disclaimer, the term of this patent is extended or adjusted under 35 U.S.C. 154(b) by 100 days.

This patent is subject to a terminal disclaimer.

(21) Appl. No.: 11/278,905

(22) Filed: Apr. 6, 2006

(65) Prior Publication Data

US 2007/0107109 A1 May 17, 2007

Related U.S. Application Data

(63) Continuation of application No. 10/604,283, filed on Jul. 8, 2003, now Pat. No. 7,047,570.

(51) Int. Cl.
*A41D 13/00* (2006.01)

(52) U.S. Cl. ..... 2/102

(58) Field of Classification Search ..... 2/456, 2/460–463, 44, 45, 50, 51, 69.5, 2.5, 94, 2/108, 326, 327–334, 102
See application file for complete search history.

(56) References Cited

U.S. PATENT DOCUMENTS 761,113 A 5/1904 Van Wagoner et al.
842,498 A 1/1907 Schmidt
1,776,044 A 9/1930 Roehm
2,148,152 A 2/1939 Dosberg (Continued)

FOREIGN PATENT DOCUMENTS

CA 652244 6/1962

OTHER PUBLICATIONS

Figures A1-A6 illustrate the DAP vest discussed in the background of the subject application. The vest shown has an ID tag claiming a manufacture date of 1990 and denotes the vest as Model A1-IIIA and named A1-TAC-DPSO. Figures A1-A6 show the vest from the front side. Figure A1 shows the cable in the retaining loops closing the armor pocket. Figure A2 shows the cable removed and the loops out of their grommets. Figure A3 shows the cable removed and the loops out of their grommets. Figure A4 shows the vest with the cable installed and the closure flap.

(Continued)

*Primary Examiner*—Tejash Patel
(74) *Attorney, Agent, or Firm*—Blackwell Sanders Peper Martin LLP

(57) ABSTRACT

A vest is provided that may be quickly and easily removed from a wearer of the vest. The vest includes a waist belt, an optional cummerbund, and shoulder straps which may be easily released from the vest by the use of a flexible retainer in cooperation with a connector device which secures the waist belt, optional cummerbund and shoulder straps to the vest in a releasable manner. A cable portion of the retainer moves in a generally straight line except for accommodating curved portions of the body of the wearer. An accessory pouch may also be provided which uses a strap and loop arrangement on the vest and pouch to attach the accessory pouch to the vest.

17 Claims, 9 Drawing Sheets

U.S. PATENT DOCUMENTS

| | | | |
|---|---|---|---|
| 2,343,142 | A | 2/1944 | Freedman |
| 2,442,895 | A | 6/1948 | Hill |
| 2,654,964 | A | 10/1953 | Stoll |
| 3,934,848 | A | 1/1976 | Snyder |
| 4,044,478 | A | 8/1977 | Girard |
| 4,117,609 | A | 10/1978 | Helt |
| 4,262,865 | A | 4/1981 | Smith |
| 4,497,069 | A | 2/1985 | Braunhut |
| 4,545,773 | A | 10/1985 | Evert |
| 4,697,285 | A | 10/1987 | Sylvester |
| 5,060,314 | A | 10/1991 | Lewis |
| 5,259,093 | A | 11/1993 | D'Annunzio |
| 5,495,621 | A | 3/1996 | Kibbee |
| 5,512,348 | A | 4/1996 | Mazelsky |
| 5,516,234 | A | 5/1996 | Duchesne |
| 5,724,707 | A | 3/1998 | Kirk et al. |
| 5,785,011 | A | 7/1998 | Gitterman, III |
| 5,806,740 | A | 9/1998 | Carlson |
| 5,897,468 | A | 4/1999 | Lumpkin |
| 5,966,747 | A | 10/1999 | Crupi et al. |
| 6,029,270 | A | 2/2000 | Ost et al. |
| 6,035,452 | A | 3/2000 | Braxton |
| 6,098,196 | A | 8/2000 | Logan |
| 6,164,048 | A | 12/2000 | Rhodes |
| 6,185,738 | B1 | 2/2001 | Sidebottom |
| 6,308,334 | B1 | 10/2001 | Maas |
| 6,421,833 | B2 | 7/2002 | Khanamirian et al. |
| 6,769,137 | B2 | 8/2004 | D'Annunzio |
| 6,948,188 | B2 | 9/2005 | D'Annunzio |
| 7,020,897 | B2 | 4/2006 | Johnson |
| 7,047,570 | B2 | 5/2006 | Johnson |

OTHER PUBLICATIONS

Point Blank Body Armor, Inc., Nato QR Full Spectrum Battle Equipment, Digital Photographs (B1-B8) with details of cable release system using multiple cables taken Jul. 2004.

Digital Photographs C1, C2 and C3 for a Cut Away Vest. Digital Photographs are of a prior art vest. It includes a four cable release system to effect cut away of the vest C1. The shoulder straps each have a cable connection C3 and the sides each have a cable connection C2. The four cable connections are similar in construction. The vest has been referred to as a FSBE I vest.

Digital Photographs D1-D7 for a Cut Away Vest. Digital Photographs show a TAC-VDG vest that went through several design changes, six versions were believed to have been designed. It is not clear which version the illustrated vest is. One version (unknown) which was sold on or about Jun. 18, 2002. Fourteen units of version four were sold on Oct. 20, 2002. The specific design of what was sold is currently unknown. The shoulders were each joined by a respective cable. D2 and the belt or sides and cummerbund were connected by a third cable D3.

Attachments E1-E11 show what is believed to be an M1 flak jacket used in the latter part of World War II by American flyers. This flak jacket utilized a pull cord as seen in Attachment E3 that when pulled separates snaps as seen in Attachments E1 and E2 allowing the flak jacket to fall downwardly off the wearer in the event the wearer needs to ditch the flak jacket in an emergency situation. The flak jacket included armor plates to protect the wearer. Apparently, the armor stayed with the various portions of the flak jacket when the vest was released from the wearer.

Attachments F1-F4 show World War II flak jackets including the M1 flak jacket and the M12. It is not clear from the photos what the construction of the M12 jacket includes. The Attachment F3 appears to show the M1 flak jacket as it would be released from the wearer.

Attachment G1-G10 illustrates a releasable vest apparently produced by Point Blank Body Armor, Inc. Attachment G3 describes the vest as being designed for quick release. Structural details of the vest are not disclosed in the article. There is a reference in Attachment G3 about the vest having a quick ejection hard armor plate pocket.

Attachment H—U.S. Army Natick Soldier Center, USMC Full Spectrum Battle Equipment, website printout (several views of the vest are included). This body armor/vest is believed to be the vest produced by Point Blank Body Armor, Inc. which was referred to in the original Information Disclosure Statement.

Attachment I—Point Blank Body Armor, Inc., Nato QR Full Spectrum Battle Equipment, website printout dated Nov. 5, 2003.

CUT AWAY VEST

CROSS REFERENCE TO RELATED APPLICATION

This application is a continuation application of U.S. patent application Ser. No. 10/604,283, filed Jul. 8, 2003 now U.S. Pat. No. 7,047,570; the entire disclosure of which is hereby incorporated by reference.

BACKGROUND OF INVENTION

A cut away vest that may be simply and quickly removed in emergency situations. The vest is particularly usable in tactical and military operations.

Vests, particularly those used in tactical and military operations are well known. The vests are used to carry personal supplies and equipment, e.g., ammunition clips, flashlights, radios and first aid supplies. The vests can also be used to carry bullet resistant armor to help protect the wearer from being wounded in vital body areas. However, the vests have many drawbacks. One problem encountered with such vests is their weight when loaded with supplies. Soldiers have been known to drown because of the weight of the vests which may in part be due to a soldier's inability to remove the vest in an emergency situation. Proposals have been made to improve such vests. An example of a vest of the cut away style, i.e., removable by the soldier without having to unfasten belts and other typical retainers, can be found in published U.S. Patent Application 2002/0120973 to T. B. D'Annunzio. This type of vest is referred to as a cut away vest in which through the use of a release device the entire vest can be removed by the soldier without having to unfasten a series of buckles, clips, hook and loop fasteners, etc. This particular vest utilizes front and rear torso portions with the rear torso portion including a cummerbund to help retain the rear torso portion to the waist of a user. A waist belt is also provided to help retain the front and rear torso portions to the waist of the user. Shoulder straps are provided with the strap portions on the front torso portion being connected to the strap portions on the rear torso portion. Four cables are attached to a handle with each cable being used to releasably retain one of each of the two shoulder straps, the cummerbund and the belt as a unit and when the cables are pulled, these components are released allowing the vest to drop off of the user.

Such a structure though, presents problems. Multiple points of attachments are used, each utilizing a separate cable for release. Each of the cables goes through a loop. A loop is formed by inserting strap portion through the hole in a buckle or the like with the axis of the loop opening being fixed by the buckle and the strap or strap to which it is attached. When viewing these connections, particularly at the shoulder straps, the cables bend generally to a right angle requiring the cable to be pulled around a corner for release from the loop and buckle arrangement. The use of four cables also requires additional time to assemble the vest. The use of such a cable arrangement makes it unnecessarily difficult to release the vest from the wearer. Also, the rear shoulder portions of the shoulder straps are connected to the front shoulder strap portions complicating use and construction of the vest. When the vest is "cut away," the belt is separated from the vest at two ends, the cummerbund is separated at one end and each of the shoulder straps is separated into the front and rear portions at the top of the shoulders.

As discussed, even though the above described vest provides advantages over non-cut away constructions, improvement is still needed.

SUMMARY OF INVENTION

The present invention involves the provision of a cut away vest usable for carrying supplies and equipment and is constructed for a quick release from attachment to a wearer so that the vest can be discarded quickly and effectively in an emergency. The vest also includes pouches that may be easily and effectively mounted on the vest at various locations through the use of a simple fastening system.

In one embodiment, the vest includes front and rear torso panels connected together around the waist of a wearer by a belt. Shoulder straps are provided that connect the front torso panel to the rear torso panel. The shoulder straps are releasably connected to the rear torso panel via a connector device that may easily be separated from the front of the vest by the activation of a flexible retainer. Activation of the retainer will release the shoulder straps from attachment to the rear torso panel. The retainer may also be used to separate the belt from the rear torso panel as well as a cummerbund if used. It is preferred that the shoulder straps, cummerbund and belt be releasably connected at a common point and that the retainer be movable in a generally straight line, except for the accommodation of curvature of the body, to effect simultaneous release of the attachment of the shoulder straps, belt and cummerbund.

A supply pouch is attachable to the vest through the use of a strap or web connected to the pouch which alternately extends through loops on the pouch and vest allowing the pouch to be mounted securely in a selected desired position on the vest either at the sides or on the front and back torso panels.

BRIEF DESCRIPTION OF DRAWINGS

Like numbers throughout the various Figures designate like or similar parts.

DETAILED DESCRIPTION

Figure 1:
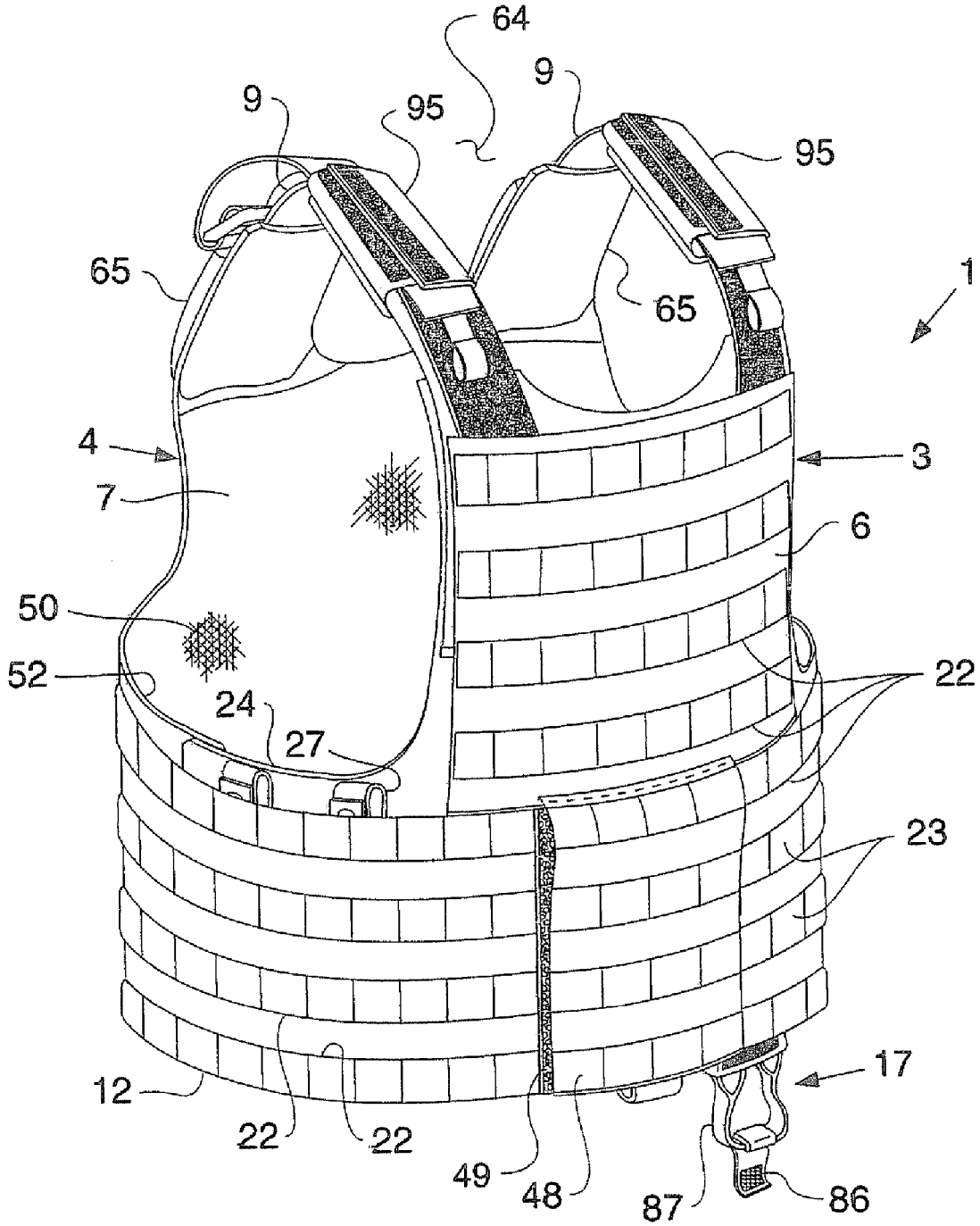
FIG. 1 is a perspective view of the cut away vest of the present invention.

In the illustrated embodiment of the present invention, the cut away vest, designated generally 1, is comprised of a front 3 and a back 4. The front 3 includes a front torso panel 6 and the back 4 includes a back or rear torso panel 7. The front 3 and back 4 are connected together by shoulder straps 9 and a waist belt 12. An internal cummerbund 14 may be provided to help secure the back 4 to a vest wearer or user. Quick release means, designated generally 17, is provided to effect separation of portions of the vest 1 from one another so that the vest may be easily and quickly removed from the wearer particularly in an emergency situation. One or more accessory pouches, FIGS. 3A, B and FIG. 4, designated generally 19, may also be provided for mounting at various locations on the vest 1. Bullet resistant armor 21, FIG. 5, may also be provided in both the front and back torso panels 6, 7.

The front 3 is comprised of a front torso panel 6 formed by multiple overlying layers of sewn fabric. The front 3 may also be provided with a plurality of rows, both vertically and horizontally oriented, of loops 22, FIGS. 1, 3. The loops 22 are formed by horizontally extending webs 23 sewn to the torso panel 6. The front 3 may also be provided with a side portions 24 for wrapping partially around the waist of the wearer. The sides 24 may be provided with accessory pouches integrally formed thereon. Attachment devices 27 may be provided to assist in attaching equipment to the vest 1. The attachment devices 27 are shown as webs working in combination with hook and loop fasteners, strips 28, 29, FIG. 4. The attachment devices 27 may also utilize snap connector 31 to permit removal of a portion thereof. Use of hook and loop fasteners allows for adjustment of the length and the position of the attachment of accessories. Pouches 33 may also be provided. The front 3 may be provided with an internal pouch (not shown) for holding the armor 21. The shoulder straps 9 include front strap portions 37 which may be attached to the front 3. The front strap portions 37 may be provided with a hook and loop fasteners portions 39 for a purpose later described.

The front 3 is preferably provided with an attachment device 40 positioned on the inside of the front 3 adjacent the middle and on the inside of the front 3 for help in securing and carrying a portion of the quick release means 17 for ready access by the wearer. A guide channel 42, which is in the form of a sewn elongate tube, is part of the front 3 and is used to receive therein a portion of the quick release means 17 to retain it to the front 3 and form a pathway for movement of a portion of the quick release means 17 therethrough as later described. The front 3 may also be provided with an attachment device 45 (FIG. 4) for releasably securing a portion of the waist belt 12 thereto as later described. A cover 48 may be provided on the front 3 to cover portions of the waist belt 12 thereunder and to help retain the connection of the ends 80 L, R of the waist belt to one another and to the vest front 3. The attachment device 45 may include hook and loop material portions 49 and the cover 48 may also be provided with hook and loop fastener portion 49 whereby the cover 48 may be secured to the attachment device 45 and yet be releasably attached thereto. The front 3 of vest 1 may also be lined with mesh lining to both form a pouch and for comfort of the wearer.

Figure 8:
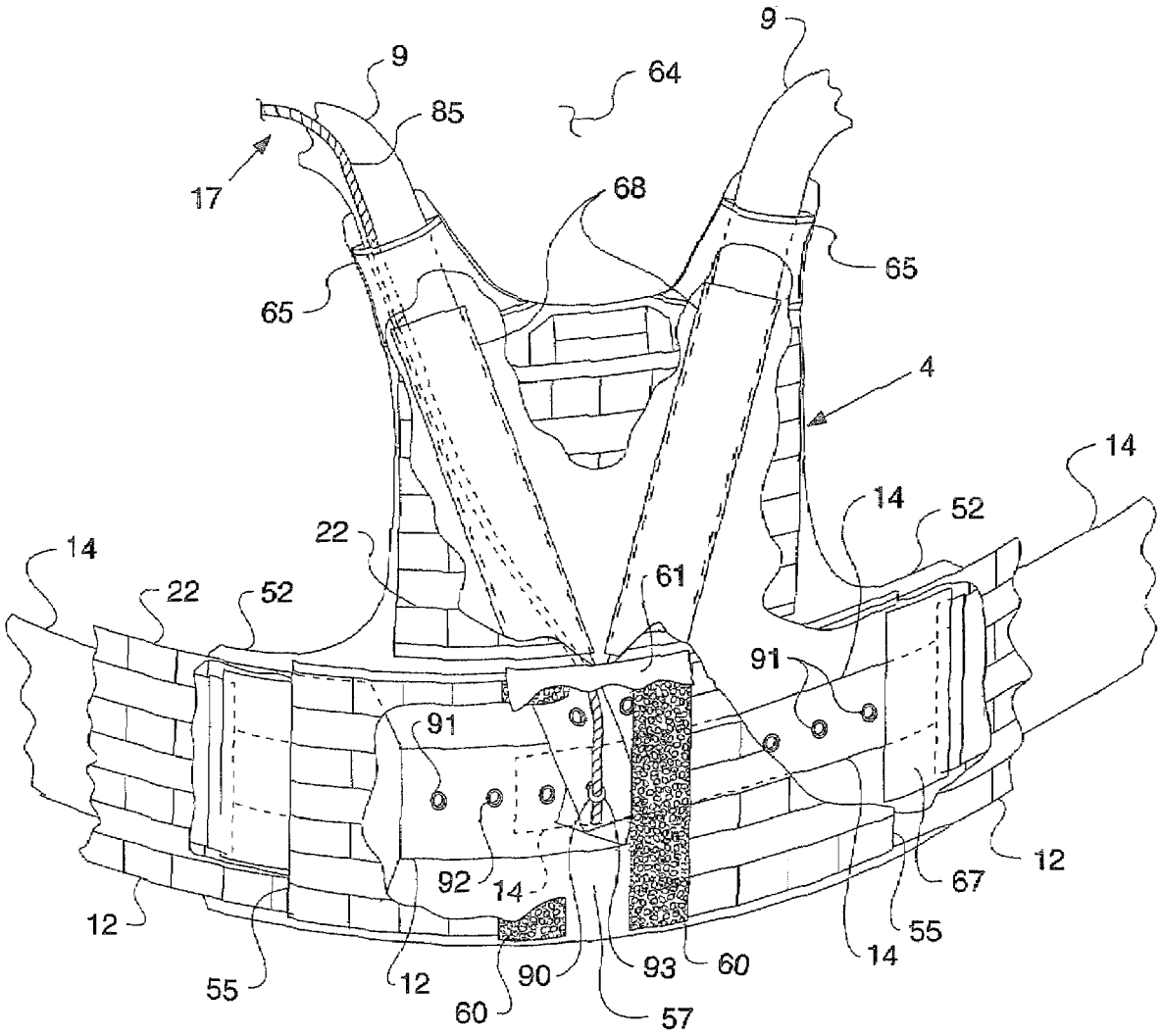
FIG. 8 is a perspective view of the rear torso panel with portions broken away to show details of the connection of the belt, cummerbund and shoulder straps to the rear torso panel and of the connector device.
Figure 9:
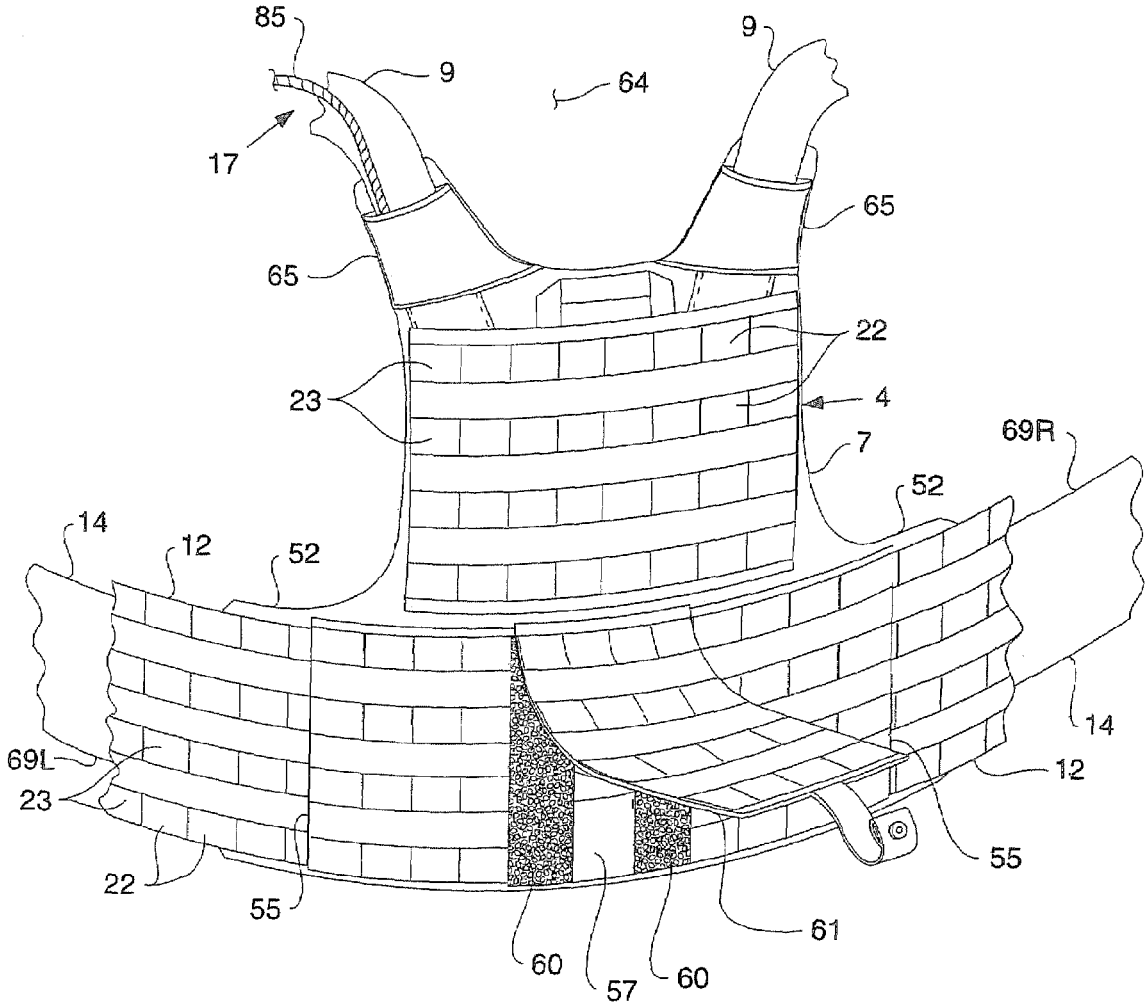
FIG. 9 is an elevation view of the rear torso panel viewed from the outside.

The back 4 (FIGS. 4, 5, 8) includes the back torso panel 7. At the lower portion of the back 4 there are side portions 52 which will wrap partially around the waist of the wearer. On the lower portion of the back 4 there is also provided a pair of generally horizontal and aligned sleeves 55 for receipt therethrough of portions of the cummerbund 14 and waist belt 12. There is an opening or gap 57 between the inside edges of the sleeves 55 for a purpose later described. On opposite sides of the opening 57 there are provided attachment devices such as hook and loop closure elements 60 which will releasably retain a cover flap 61 in overlying relation to the opening 57 allowing the opening 57 to be selectively exposed and covered. The back 4 further contains a pouch 63, FIG. 5, for holding armor 21 when desired. As with the front 3, the inside surface of the back 4 may be a mesh lining 50. Additional pouches (not shown) may be formed between the mesh lining 50 of the back 4 and the remainder of the back for storing accessories or supplies.

Figure 4:
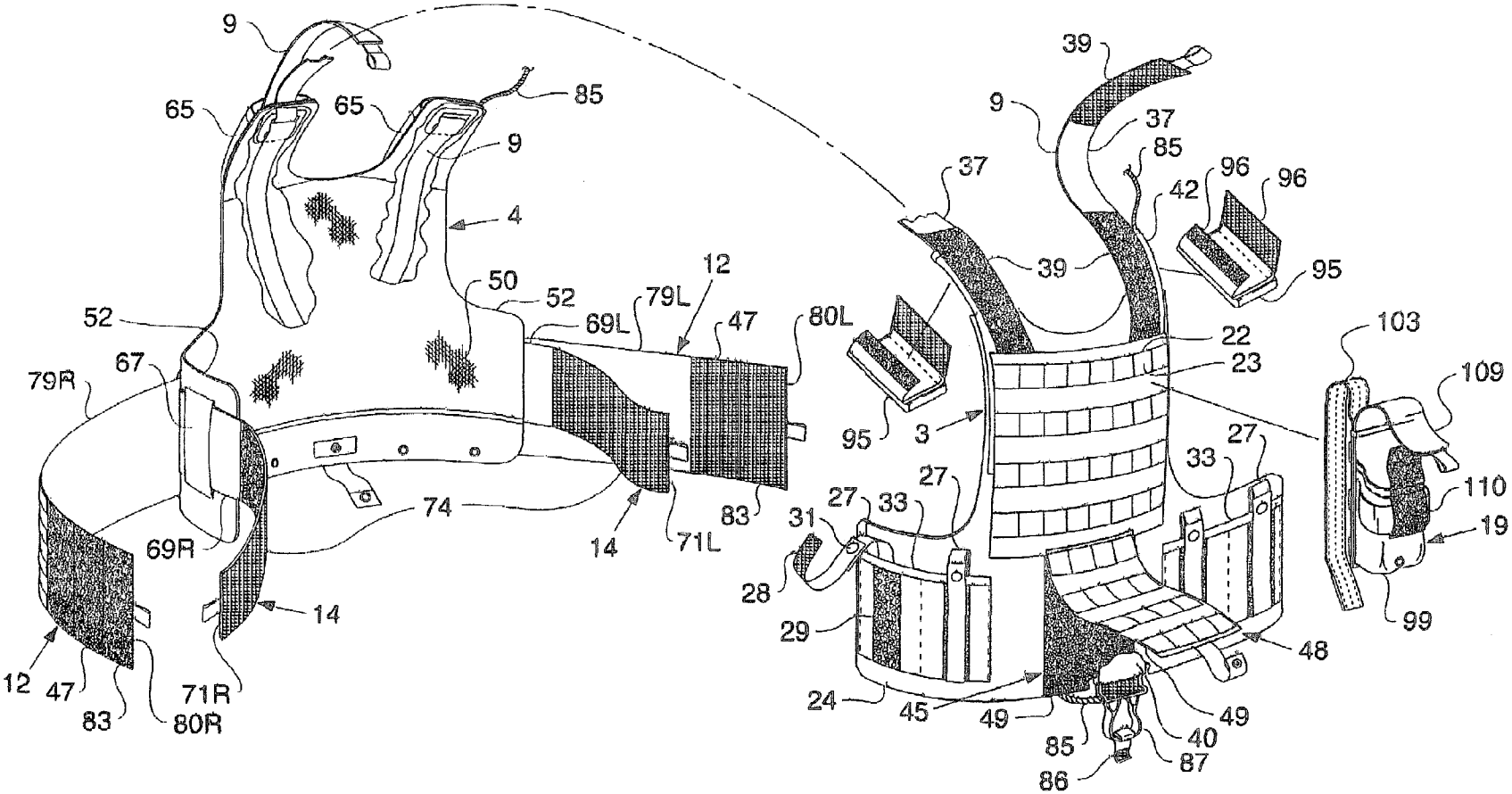
FIG. 4 is an exploded perspective view of the vest.
Figure 5:
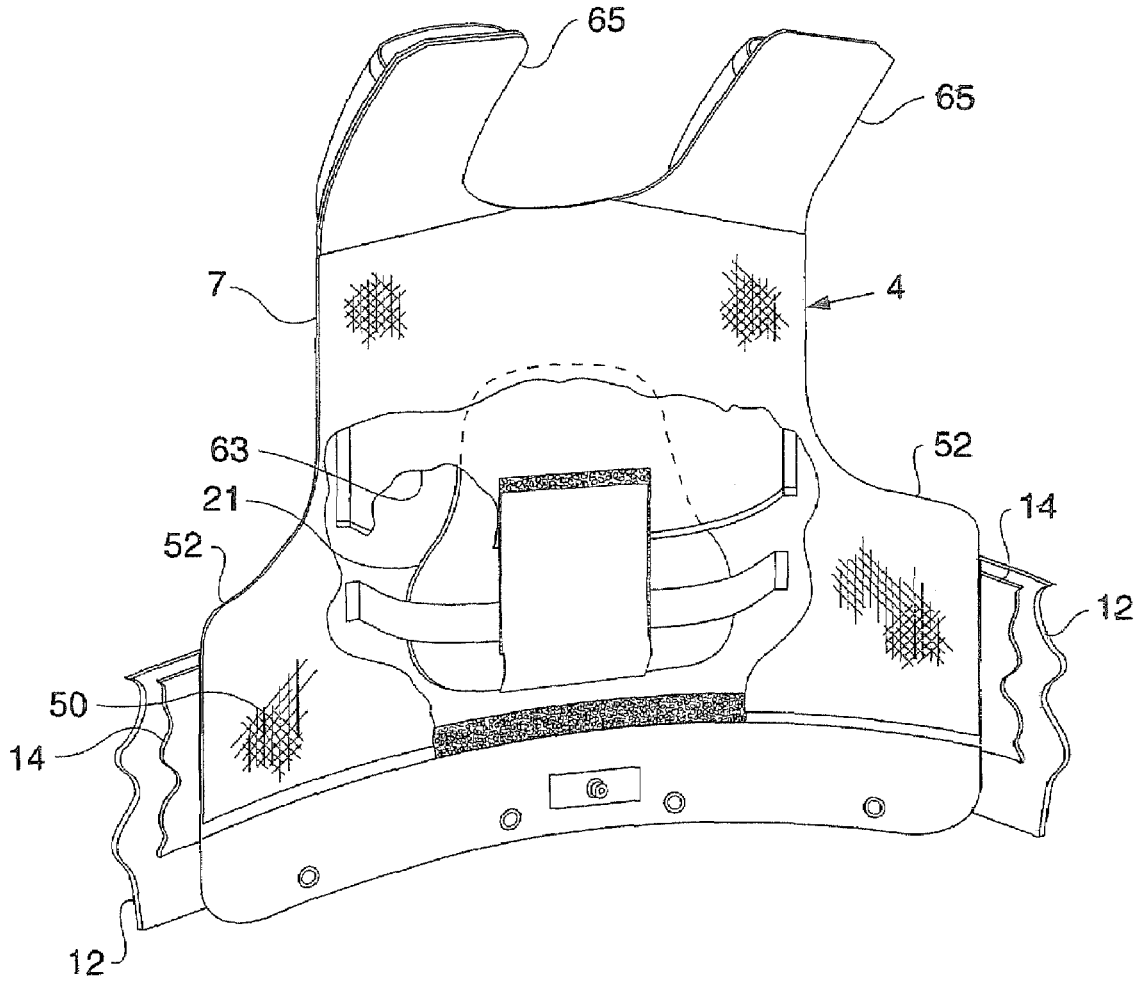
FIG. 5 is a perspective view of the rear torso panel seen from the inside of the rear torso panel.

Ears 65 in the form of flat tubes are provided adjacent the upper edges of the main portion of the back torso panel 7 and are separated laterally to form an opening 64 for the neck of a wearer. The ears 65 may be padded for comfort and they may directly overlie a portion of the wearer. The exterior of the back 4 may be provided with vertically and horizontally spaced loops 22 as does the front 3. The loops 22 on the back 4 may be utilized for the releasable attachment of accessory pouches or equipment and accessories to the vest 1. Sleeves 67, FIG. 4, are formed on the sides 52 for receipt of portions of the cummerbund 14 therethrough and to help separate the cummerbund from the belt 12 and also provides support for the back 4 during use by the wearer. The sleeves 67 are aligned with one another, and have an axis generally parallel to and preferably in line with the axis of the belt sleeves 55 and extend generally horizontally. The remainder of the cummerbund 14 inside the back 4 passes through a respective belt sleeve 55 and may extend partly or completely through the belt sleeve 55 on the opposite side of the back 4. Sleeves 68 (FIG. 8) extend from adjacent to the bottom edges of the ears 65 to an area adjacent the opening 57 for receipt therethrough of portions of the shoulder straps 9. Sleeves 68 incline downwardly and inwardly from the ears 65 toward the center and bottom of the back 4 adjacent the opening 57.

Figure 2:
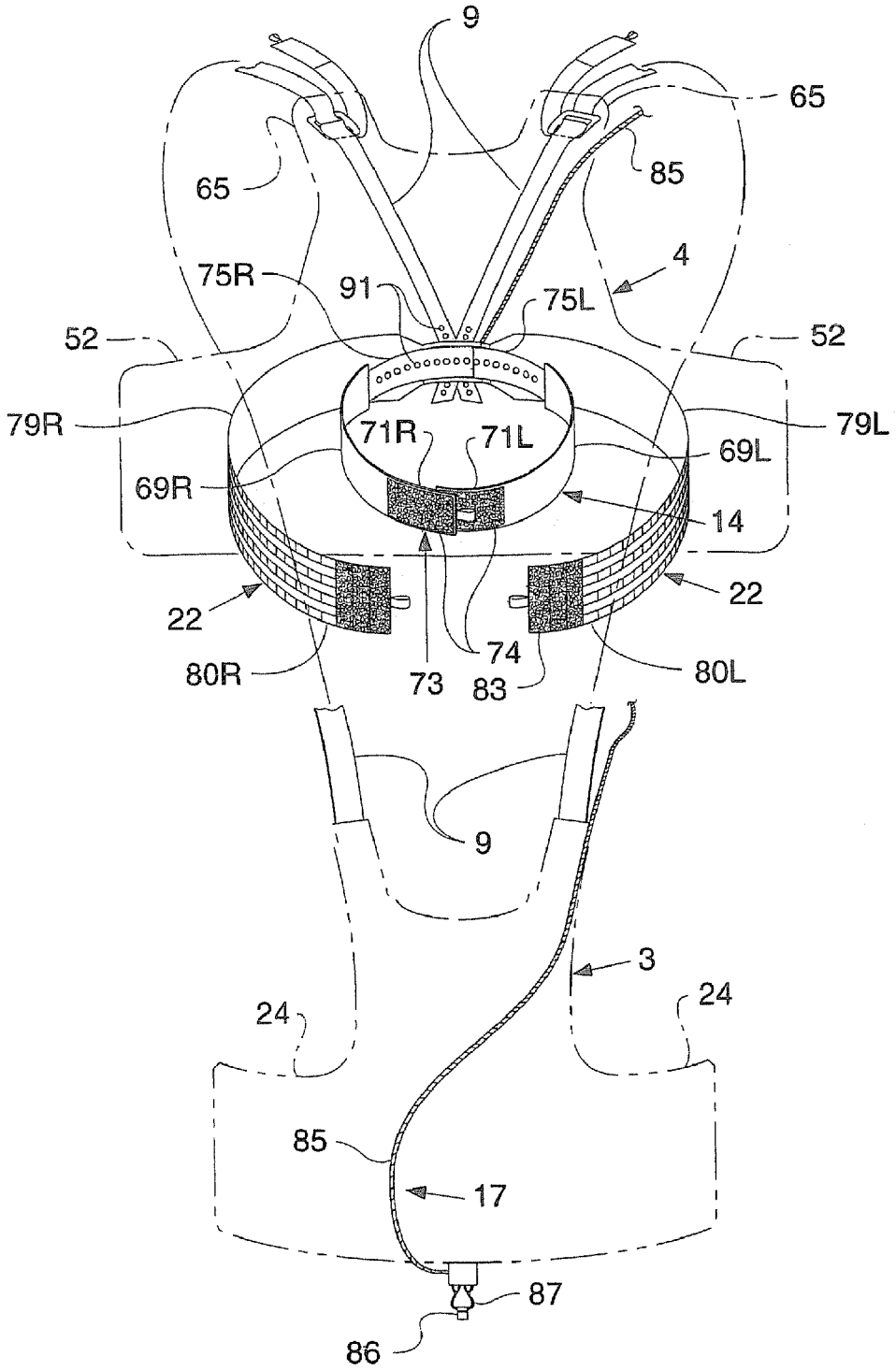
FIG. 2 is a schematic perspective view showing the shoulder straps, cummerbund and waist belt and their relationship to one another and to the rear torso panel.
Figure 6:
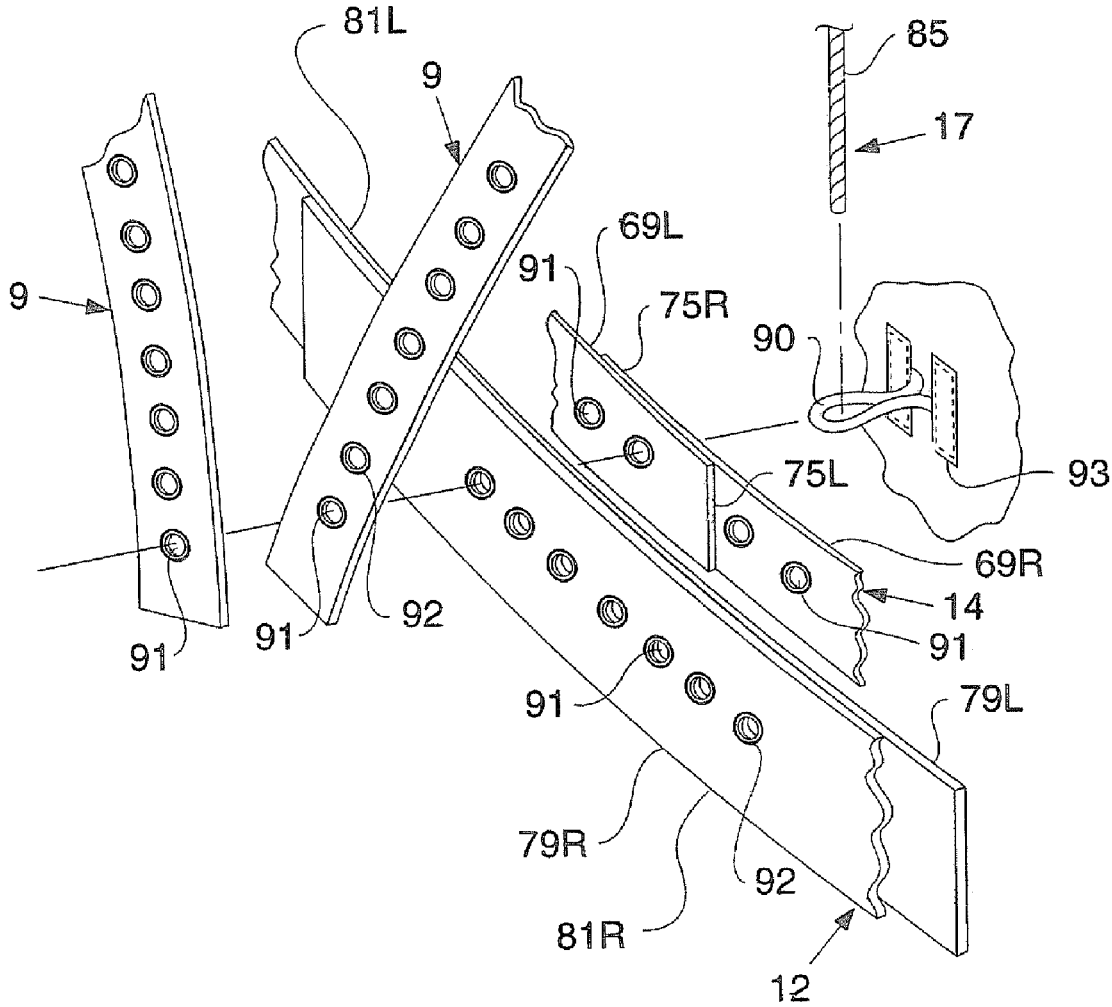
FIG. 6 is a fragmentary exploded view of the belt, cummerbund and shoulder straps showing the details of the connection of the belt, cummerbund and shoulder straps to the connector device connecting the same to the rear torso panel.
Figure 7:
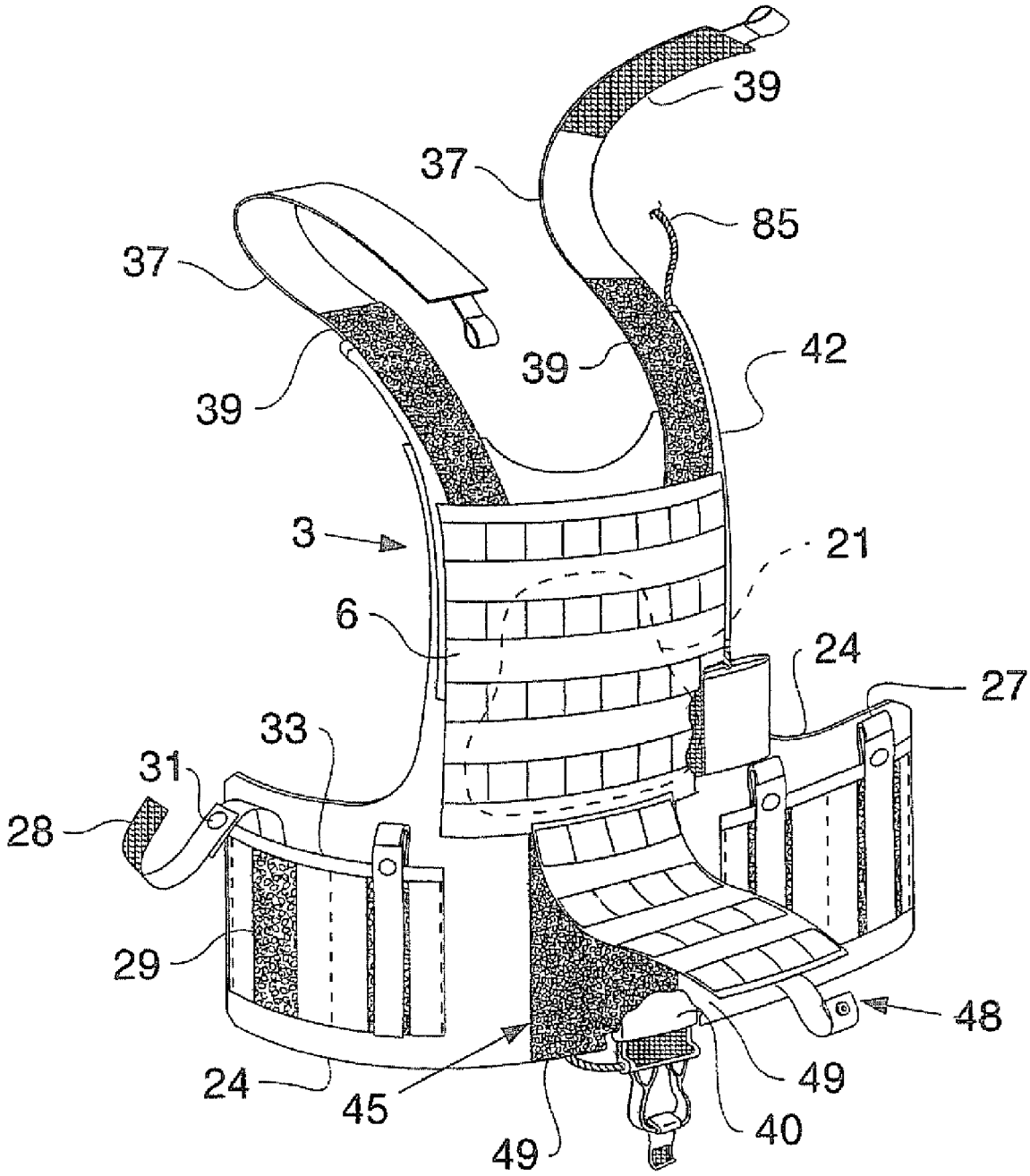
FIG. 7 is a perspective view of the front torso panel showing various details thereof and of an armor plate carried thereby shown in phantom.

The illustrated cummerbund 14, FIGS. 2, 4, and 6, is in the form of a belt with left and right side portions 69L, R respectively and has a width of, for example, approximately 4 inches. The cummerbund 14 is constructed to have adjustable length to accommodate different size wearers. As shown, each of the cummerbund side portions 69 L, R has an end 71 L, R, respectively (preferably free ends), which would be positioned at the front of the wearer and has an attachment device 73 at the free ends. Any suitable attachment device 73 can be used, for example, buckles, clasps, etc. In the illustrated structure, a hook and loop fastener arrangement 74 is utilized with the hook portion of fastener 74 on one free end 71 and the loop portion of fastener 74 secured to the other of the free ends 71. In the illustrated structure, each of the cummerbund portions 69 L, R also has an end 75 L, R for attachment at the back of the back 4. However, it is to be understood that one of the ends 75 may be permanently attached to the vest 1 so long as one portion of the cummerbund may be released from the vest and the wearer in a manner later described. Preferably both ends 75 are free ends. The ends 75 of the cummerbund 14 may overlap inside the back 4 and portions of the cummerbund 14 are accessible through the opening 57. The cummerbund 14 is releasably attached to the vest 1 in a manner later described whether or not the attachment device 73 is closed or open.

The belt 12 has two side portions 79 L, R at least one of which is releasable from the vest 1 in a manner later described (FIGS. 2, 6). Each side portion 79 L, R has opposite ends 80 L, R, 81 L, R respectively which are preferably free ends, with the end 80 being positioned adjacent the front of the wearer and vest 1 and the end 81 being positioned at the back of the wearer and vest 1. In illustrated embodiment, both portions 79 of the belt 12 are completely releasable from the vest 1. The ends 81 of the belt portions 79 are received through the sleeves 55 and are exposed for access through the opening 57. The belt 12 at the ends 80 may be provided with an attachment device for securement of the portions 79 to one another and preferably to the vest front 3. As seen, hook and loop fastener elements 82, 83 are provided allowing the ends 80 to be releasably attached to one another and to the attachment device 45 on the front 3. The cover 48 may also be secured through a hook and loop fastener arrangement 49 to the exposed surface of the belt 12. The belt 12 may also be provided with the vertically and horizontally extending rows of loops 22. The ends 81 are received through the sleeves 55 and portions of the belt 12 are exposed for access through the opening 57. Preferably, the belt side portions 79 are portioned outside of the cummerbund side portions 69.

The quick release means 17 is operable for selectively retaining and releasing at least one belt portion 79, at least one cummerbund portion 69 and at least one shoulder strap 9 from the vest 1 in a manner that the vest may be quickly and easily cut away from the wearer in a reliable and quick manner. In the illustrated structure, the quick release means 17 includes a flexible retainer such as a plastic coated metal cable 85 having a handle 87 on one end and attachable and accessible to the front 3 and releasably retained in position by a fastener 86. The cable 85 is carried by both the front and rear torso panels 6 and 7 and passes through the channel 42, ears 65 and sleeve 68 and extends down to the area of the opening 57 for access by a user and releasably secures at least one of the belt 12 side 79, cummerbund 14 side portion 69, and at least one shoulder strap 9 to the vest 1 in a releasable manner. The attachment is shown being effected on the back torso panel 7. It is to be understood that the attachment in an alternative embodiment can be on the front torso panel 6. It is however preferred that the attachment be made on the back 4. The quick release means 17 further includes a multi-orientation and self-aligning (the cable 85 can orient and maintain orientation of the loop 90) attachment device such as a flexible fabric loop 90 attached to the back torso panel 7, as by sewing, and has a length sufficient to pass through at least one shoulder strap 9, one cummerbund portion 69, and at least one belt portion 79. As shown in FIG. 6, both shoulder straps 9, cummerbund portions 69 L, R and belt portions 79 L, R each have a plurality of spaced apart openings 91 extending longitudinally in a respective row along a portion of the length thereof. Preferably, the openings 91 are formed by metal eyelets 92 secured thereto through which the loop 90 may be passed. In order, from inside to outside the belt portions 79 which overlie the cummerbund portions 69 and the straps 9 having their end portions overlying the belt portions 79. The loop 90 is passed through generally aligned eyelet openings 91 and the cable is then passed through the open end 93 of the loop 90 releasably securing the belt 12, cummerbund 14 and straps 9 to the back torso panel 7. The cable 85 will align the loop 90 for generally straight line movement of the cable during release movement by pulling the cable 85 out of the loop 90. With the cable 85 out of the loop 90, the belt 12, cummerbund 14 and straps 9 are released from attachment to the back 4 allowing the front 3 and back 4 to separate with the straps 9 being pulled through the sleeves 68 whereby the front 3 and back 4, will under their own weight, fall from the wearer. The weight of the vest 1 and the accessories attached thereto are sufficient to effect release of the vest from the wearer when the cable 85 is no longer retained in the loop 90.

In the illustrated embodiment, the portion of the cable 85 from the loop 90 to the wearer's shoulder moves in a generally straight line, then can move around the curvature of body portions, e.g. the shoulder of the wearer to effect release of the vest 1 from the wearer. Although multiple attachment points could be used, for example the shoulder straps could have their own attachment loop 90 while the belt and cummerbund could share a common loop or other arrangements of these points could be used. It is preferred that the attachment is made through a single attachment point. If multiple attachment points are used, they are to be generally aligned in order that the cable 85 may still move in a straight line (except for accommodating body curvature) through the attachment points.

While the attachment point is shown on the back 4, it is to be understood that the attachment point can be on the front 3. The handle 87 is shown as positioned at the lower portion of the front 3, however, it is to be understood that it could be positioned at different locations. One military service currently prefers that it be at the lower part of the front of the vest 1 while another service currently prefers that it be adjacent an upper portion of the front 3, i.e., adjacent the shoulder of the wearer. In this event, multiple cables 85 can be provided with a vest to provide the option to the wearer as to where to have the handle 87 located. The handle 87 is secured in its position by fastener 86 to help prevent accidental release. The shoulder straps 9 are connected to the front 3 and to the rear torso panel 7 and preferably are free to move through the ears 65 by not being attached thereto. Pads 95 may be provided at the shoulder straps 9 to improve the comfort of the wearer when using the vest 1. The pads 95 may be releasably mounted to the straps 9 through the use of hook and loop type fastening elements 96 whereby the pads wrap around a respective shoulder strap 9.

Figure 3A:
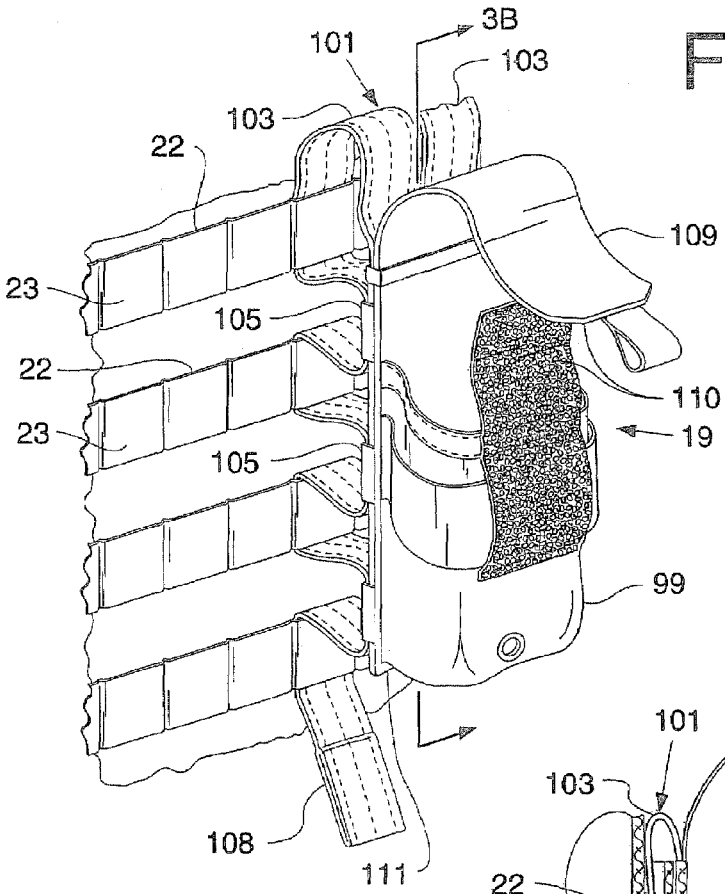
FIG. 3A is a perspective view of storage pouch mounted to the vest with the attachment straps being shown in an untightened condition.
Figure 3B:
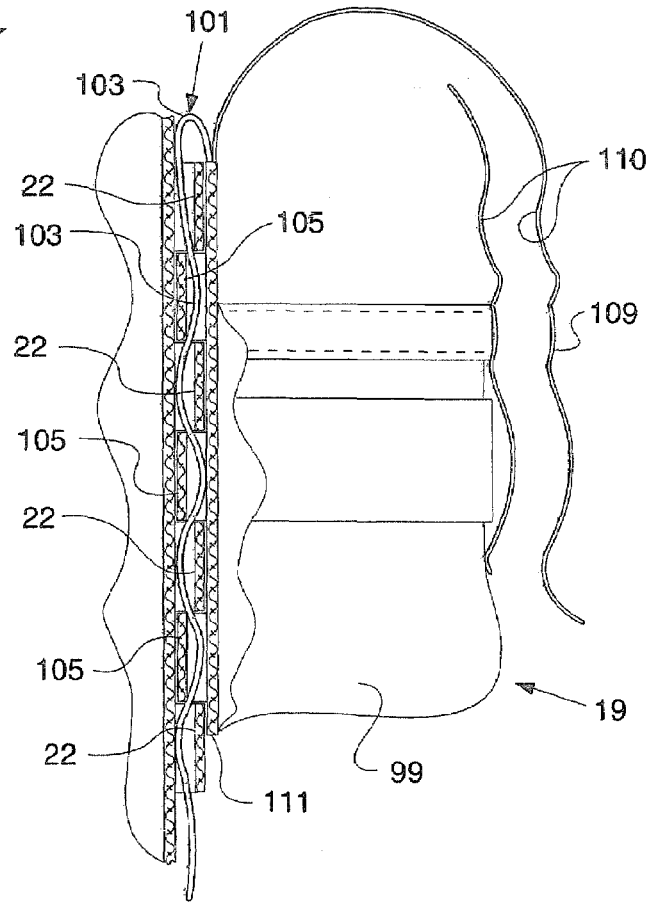
FIG. 3B is a sectional view of the storage pouch of FIG. 3A taken along the line 3B 3B of FIG. 3A showing the attachment strap in tightened condition.

An accessory pouch 19, as best seen in FIGS. 3A, B, and 4 may be removably attached to the vest 1 at any of the locations where the loops 22 exist. Accessory pouch 19 includes a pouch portion 99 with an attachment device designated generally 101 which is interengagable with portions of the vest 1 for releasable attachment of the accessory pouch 19 to the vest 1. As seen, the accessory pouch 19 includes at least one and preferably two straps 103 preferably attached to and extending from the top of the pouch portion 99. Loops 105 extend across the width, i.e., generally horizontally when in use, of the accessory pouch 19 on the back 106 thereof. A strap 103 alternately inserted in the loops 22 then loop 105 and then another loop 22 and then a loop 105 forming a weave that removably attaches the accessory pouch 19 to the vest 1. The free end of the straps 108 may be left hanging or may be inserted into a lower disposed loop 22 if desired. Accessory pouch 19 may be provided with a closeable top 109 that can be releasably attached to the pouch portion 99 via a hook and loop fastener arrangement 110 for sealing the interior of the pouch to prevent loss of material or supplies contained therein. While the straps 103 are shown as being attached and extending from the top of the pouch portion 99 they may, in an alternate embodiment, extend from the bottom 111 of the accessory pouch 19 and woven upwardly instead of downwardly through the loops 22, 105. Also, one strap 103 may extend from the top and one may extend from the bottom. Thus, the entire length or height of the accessory pouch 19 can be firmly held against the vest 1.

Thus, there has been shown and described several embodiments of a novel cut away vest, which fulfills all of the objects and advantages sought therefor. Many changes, modifications, variations and other uses and applications of the present constructions will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The invention claimed is:

1. A cut away vest comprising:

a first vest portion with a first torso panel;

a second vest portion with a second torso panel;

shoulder straps connected to the first torso panel extending to the second torso panel, at least one said shoulder strap having a free end and at least one first connector element;

a waist belt having at least one side portion with a free end connecting a lower portion of one of the first torso panel and second torso panel to the other of the first torso panel and second torso panel, said at least one belt side portion having at least one second connector element;

at least one connector device connected to the second torso panel and selectively operably associated with a respective at least one of the first and second connector elements; and a flexible single retainer element carried by at least one of the first and second torso panels engageable with the at least one connector device to releasably retain the first and second connector elements associated each with a respective said connector device whereby a portion of the retainer element is movable from engagement with the at least one connector device to release the first and second connector elements from their respective connector device.

2. A cut away vest as set forth in claim 1 wherein the first and second connector elements including holes through a portion of said at least one shoulder strap and said at least one waist belt side portion respectively.

3. A cut away vest as set forth in claim 2 wherein said at least one connector device including a plurality of loops secured to the second torso panel and the single flexible retainer element passing through said loops.

4. A cut away vest as set forth in claim 2 wherein each said shoulder strap having a free end portion and at least one said first connector element and said waist belt having at least two side portions each with a respective free end, each said waist belt side portion having at least one second connector element, said at least one connector device being one connector device operably associated with at least one of said first connector element in each of the shoulder straps and at least one said second connector element in each of said waist belt side portions.

5. A cut away vest as set forth in claim 4 wherein the first and second connector elements including holes and said connector device including a flexible loop attached to the second torso panel selectively extendable through holes of the first and second connector elements.

6. A cut away vest as set forth in claim 5 wherein the flexible retainer element including a single flexible cable extending from the connector device to the first torso panel, said flexible retainer element also including a handle portion adjacent an end of the cable and carried by the first torso panel.

7. A cut away vest comprising:

a front torso panel;

a rear torso panel;

shoulder straps connected to the front torso panel extending therefrom to the rear torso panel, said shoulder straps each having a respective free end and at least one respective first connector element;

a waist belt having at least one side portion with a free end, said waist belt connecting a lower portion of one of the front torso panel and rear torso panel to the other of the front torso panel and rear torso panel, said at least one belt side portion having at least one second connector element;

at least one connector device connected to the rear torso panel and selectively operably associated with a respective at least one of the first and second connector elements; and a flexible retainer element at least partially carried by the rear torso panel to releasably retain the first connector elements to a common said connector device and the second connector element associated with a said connector device whereby a portion of the retainer element is movable to release the first and second connector elements from their respective said connector device.

8. A cut away vest as set forth in claim 7 including a cummerbund associated with the rear torso panel and having at least two side portions with first ends positionable at the front of a vest wearer and having at least one of the cummerbund side portions with a second free end overlying a portion of the rear torso panel adjacent at least one said connector device, said cummerbund having at least one third connector element selectively operably associated with said at least one said connector device and releasably retained to the rear torso panel by the flexible retainer element.

9. A cut away vest as set forth in claim 7 wherein the retainer element including a single cable connecting the shoulder straps to a common said connector device.

10. A cut away vest as set forth in claim 9 wherein said waist belt having at least two side portions each with a free end with each waist belt side portion having at least one second connector element, said at least one connector device being one connector device operably associated with at least one said first connector element in each of the shoulder straps and at least one said second connector element in each of said waist belt side portions.

11. A cut away vest as set forth in claim 9 wherein said waist belt having at least two side portions each with a free end with each waist belt side portion having at least one second connector element, said at least one connector device including a plurality of connector devices each operably associated with a respective at least one said first connector element and at least one said second connector element.

12. A cut away vest as set forth in claim 10 wherein the first and second connector elements including holes and said connector device including a single flexible loop attached to the rear torso panel selectively extendable through holes of the first and second connector elements.

13. A cut away vest as set forth in claim 9 wherein each of the shoulder straps and said at least waist belt side portion having a plurality of first and second connector elements respectively in spaced apart relation to provide adjustability of length of the shoulder straps and waist belt.

14. A cut away vest comprising:

a front torso panel;

a rear torso panel;

shoulder straps connected to the front torso panel and to the rear torso panel, said shoulder straps each having a respective free end and at least one respective first connector element;

a waist belt having at least one side portion with a free end, said waist belt connecting a lower portion of one of the front torso panel to the rear torso panel, said at least one belt side portion having at least one second connector element;

at least one connector device connected to the front torso panel and selectively operably associated with a respective at least one of the first and second connector elements; and a flexible retainer element at least partially carried by the front torso panel to releasably retain the first connector elements associated with a common said connector device and the at least one second connector element associated with a said connector device whereby a portion of the retainer element is movable to release the first and second connector elements from their association with a respective said connector device.

15. A cut away vest comprising:

a front torso panel;

a rear torso panel;

shoulder straps connected to the front torso panel extending therefrom to the rear torso panel, each said shoulder strap having a free end and at least one first connector element;

a waist belt having at least two side portions each with a free end and connecting a lower portion of the front torso panel to the rear torso panel, said belt side portions each having at least one second connector element;

at least one multi-orientation connector device connected to the rear torso panel and selectively operably associated with at least one of the first and second connector elements; and a flexible retainer element at least partially carried by the rear torso panel operable to releasably retain at least one of the first and second connector elements engaged with a respective said connector device whereby at least a portion of the retainer element being movable to release at least one of the first and second connector elements from a respective said connector device.

16. A cut away vest as set forth in claim 15 wherein the vest includes a plurality of rows of loops in vertically and horizontally spaced relationship and including a separate pouch with at least one mounting strap extending from adjacent a top portion of the pouch and having a plurality of loops on the back side of the pouch spaced vertically to fit between horizontal rows of the loops on the vest, said pouch strap alternately extending through the pouch and vest loops thereby removably securing the pouch to the vest.

17. A cut away vest comprising:

a first vest portion with a first torso panel;

a second vest portion with a second torso panel;

shoulder straps connected to the first torso panel extending to the second torso panel, at least one said shoulder strap having a free end and at least one first connector element;

a waist belt having at least one side portion with a free end connecting a lower portion of one of the first torso panel and second torso panel to the other of the first torso panel and second torso panel, said at least one belt side portion having at least one second connector element;

at least one connector device connected to the second torso panel and selectively operably associated with the first and second connector elements; and a flexible retainer element carried by at least one of the first and second torso panels and engageable with the at least one connector device to releasably retain the first and second connector elements associated with said at least one connector device whereby a portion of the retainer element is movable from engagement with the at least one connector device to selectively release the first and second connector elements from association with the at least one connector device.

* * * * *